US007762330B2

(12) United States Patent
Saylor, III et al.

(10) Patent No.: US 7,762,330 B2
(45) Date of Patent: Jul. 27, 2010

(54) METHODS OF MAKING MULTIPLE CASING CUTS

(75) Inventors: James E. Saylor, III, Conroe, TX (US); Thomas D. Helbert, Magnolia, TX (US); Marc Henderson, The Woodlands, TX (US); Joeseph V. Hebert, Tomball, TX (US); Trygve Berthelsen, Royneberg (NO); Randall Louis Hebert, Houma, LA (US); Malcolm Perschke, Spring, TX (US); A. J. Dach, III, Arlington, TX (US); Harshad Patil, Houston, TX (US); Praful C. Desai, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 16 days.

(21) Appl. No.: 12/170,362

(22) Filed: Jul. 9, 2008

(65) Prior Publication Data

US 2010/0006290 A1 Jan. 14, 2010

(51) Int. Cl.
*E21B 29/00* (2006.01)

(52) U.S. Cl. ..... 166/298

(58) Field of Classification Search ..... 166/289, 166/55.7, 55.8

See application file for complete search history.

(56) References Cited

U.S. PATENT DOCUMENTS

| | | | | |
|---|---|---|---|---|
| 2,899,000 | A * | 8/1959 | Medders et al. | 166/55.8 |
| 5,253,710 | A * | 10/1993 | Carter et al. | 166/298 |
| 6,536,524 | B1 | 3/2003 | Snider | |
| 6,629,565 | B2 * | 10/2003 | Harrell | 166/361 |
| 7,063,148 | B2 | 6/2006 | Jabusch et al. | |
| 7,188,674 | B2 * | 3/2007 | McGavern et al. | 166/298 |

FOREIGN PATENT DOCUMENTS

EP 0504848 A1 9/1992

OTHER PUBLICATIONS

United Kingdom Office Action for related Application No. GB0911805 dated Oct. 2, 2009. (5 pages).

* cited by examiner

*Primary Examiner*—William P Neuder
(74) *Attorney, Agent, or Firm*—Osha • Liang LLP

(57) ABSTRACT

Methods of removing casing from a wellbore, the method including disposing a drilling tool assembly in a wellbore, the drilling tool assembly including a cutting device, a spearing device, and a jarring device. The methods further including activating the cutting device, cutting a first casing segment, deactivating the cutting device and activating a spearing device. The method further including engaging the spearing device with the first casing segment, activating the jarring device to free the first casing segment, and removing the first casing segment from the wellbore.

20 Claims, 6 Drawing Sheets

METHODS OF MAKING MULTIPLE CASING CUTS

BACKGROUND

1. Field of the Disclosure

Embodiments disclosed herein relate generally to methods and apparatus for cutting and retrieving casing from a wellbore. More specifically, embodiments disclosed herein relate to methods and apparatus for making multiple casing cuts and removing the cut casing joints from the wellbore in a single trip.

2. Background Art

In oil and gas exploration and development operations it is often desirable to remove casing which has previously been set in the wellbore. Casing removal requires that the casing string first be severed, and the free end then pulled to the surface, to remove the severed portion.

Conventional apparatuses and techniques for extraction of well casing typically involve the use of multiple trips to move cutting and extracting equipment downhole. Thus, in removal operations a cutting device is first lowered into the wellbore to cut the casing at a desired depth after which time the cutting device is returned to the surface. A spearing device is then lowered inside the well and engaged to the free end of the casing. Once the free end of the casing is engaged, an attempt is then made to recover the casing by pulling, or, in the case jars are used, by a combination of pulling and jarring. If these attempts to remove the casing are unsuccessful, the spear assembly is removed from the wellbore and the cutting device reattached to the drill string to sever the casing at a point above the original cut. The pulling/jarring process is then repeated until the casing is recovered.

Such prior art apparatuses and techniques for retrieving well casing suffer from the disadvantage of the overall time and costs involved in completing a casing extraction. This time and expense is a result of the utilization of separate cutting and extraction tools, which are typically run downhole independently. Even when casing is retrieved without the need to complete a second cut of the casing, at least two trips are necessary for a complete cutting and retrieval operation. When a significant length of casing is extracted, considerable rig time must be used to move the tools downhole to the site of the cut. Time and expense are therefore increased when multiple cuts are necessary to retrieve the casing.

In certain operations, casing cutting may be required when performing slot recovery operations. During slot recovery, the object is to construct a new well with new barriers from a previously used slot while shutting off all communication with an old reservoir. Cutting and pulling casing may be restricted due to cement behind production casing or barite settling from drilling fluid in the production casing annulus. Such slot recovery operations may thus require the cutting and removal of multiple sections of casing from a wellbore. Because typically slot recovery operations involve cutting a casing segment in a first trip and pulling the cut casing in a second trip, such operations are often time consuming and expensive.

Accordingly, there exists a need for methods and apparatuses for cutting and pulling casing segments in a single wellbore trip.

SUMMARY OF THE DISCLOSURE

In one aspect, embodiments disclosed herein relate to methods of removing casing from a wellbore, the method including disposing a drilling tool assembly in a wellbore, the drilling tool assembly including a cutting device, a spearing device, and a jarring device. The methods further including activating the cutting device, cutting a first casing segment, deactivating the cutting device and activating a spearing device. The method further including engaging the spearing device with the first casing segment, activating the jarring device to free the first casing segment, and removing the first casing segment from the wellbore.

In another aspect, embodiments disclosed herein relate to a downhole tool for cutting and removing casing from a wellbore, the tool including a first retractable cutting device disposed on a drill string and configured to make a first casing cut and a second retractable cutting device disposed above the first retractable cutting device and configured to make a second casting cut. The tool further including a spearing device disposed on the drill string and configured to engage the casing and a jarring device disposed on the drill string.

Other aspects and advantages of the invention will be apparent from the following description and the appended claims.

DETAILED DESCRIPTION

In one aspect, embodiments disclosed herein relate to methods and apparatus for cutting and retrieving casing from a wellbore. More specifically, methods and apparatus disclosed herein relate to methods of removing casing from a wellbore by making multiple casing cuts, and retrieving the casing joints in a well slot recovery operation. More specifically still, methods and apparatus disclosed herein relate to making multiple casing cuts and retrieving multiple cut casing joints from a wellbore in a single trip.

The methods and apparatus disclosed herein include drilling tool assembly designs that may be used in the cutting and removing of casing segments from a wellbore. In accordance with embodiments disclosed herein, such operations, often referred to by those of ordinary skill in the art as slot recovery applications, include the use of a downhole tool capable of cutting casing segments, engaging the cut segments, freeing the segments, and then removing the segments from the wellbore in a single trip. Because multiple casing cuts may increase the efficiency of the operations, methods for actuating multiple downhole tools will be discussed below in detail. However, those of ordinary skill in the art will appreciate that any methods of actuating downhole tools for multiple operations known in the art may also be used according to embodiments of the present disclosure.

Figure 1:
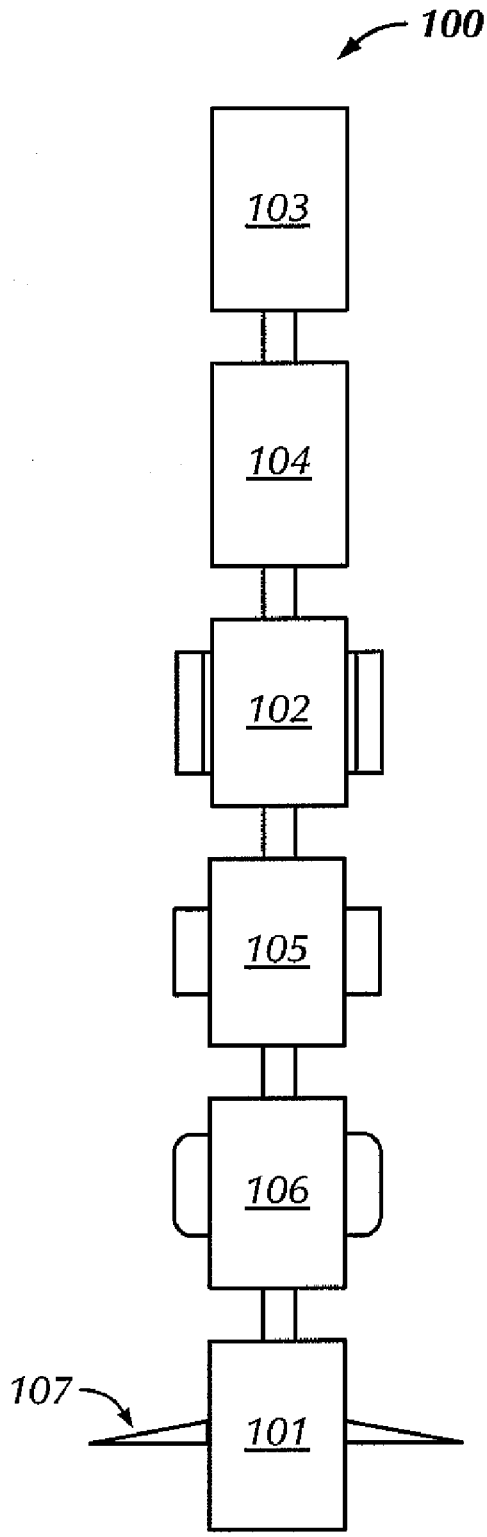
FIG. 1 is a schematic representation of a drilling tool assembly according to embodiments of the present disclosure.

Referring to FIG. 1, a schematic representation of a fishing tool assembly 100 according to an embodiments of the present disclosure is shown. In this embodiment, fishing tool assembly 100 includes a cutting device 101, a spearing device 102, and a jarring device 103. Generally, cutting device 101 may be any type of cutting device capable of cutting cemented/uncemented casing known in the art; however, specific embodiments of the present application may benefit from specific cutting devices 101, which will be described in detail below. Similarly, spearing device 102 may include any type of spearing or grappling device as typically used in fishing operations, while jarring device 103 may include various types of jarring devices known in the art. Fishing tool assembly 100 also includes multiple other components that may facilitate the slot recovery operation. The other components illustrated in FIG. 1 include a bumber jar 104, a packer 105, and a stabilizer 106. Those of ordinary skill in the art will appreciate that depending on the requirements of the slot recovery operation, multiple cutting devices 101, spearing devices 102, packoffs 105, and stabilizers 106 may be used. Such alternative configurations of drilling tool assembly 100 will be discussed in detail below.

Generally, cutting device 101 may include any type of cutting device capable of cutting casing known in the art. Such cutting devices typically include a plurality of arms 107 that may be actuated to extend from the body of the cutting device to engage casing. Typically, cutting devices include a plurality of cutting elements, teeth, or inserts disposed on the arms, such that upon actuation, the cutting elements contact the casing. Examples of cutting device actuation may include, spring loaded knives, expandable arms and/or blades with cuttings elements disposed thereon, and other cuttings devices known to those of ordinary skill in the art. As the drilling string rotates, including rotation of the cutting device, the cutting elements on arms 107 contact the casing and cut the casing to a depth defined by the extension of arms 107 and/or cutting elements. Thus, those of ordinary skill in the art will appreciate that a depth of cut into the casing may be controlled by limiting the extension of the arms and/or the protrusion from the arms of associated cutting elements. Depending on the thickness of the casing being cut, it may be beneficial to limit the depth of cut into the casing to, for example, 0.25 inches more than the casing thickness. In still other operations it may be beneficial to decrease the depth of cut to an alternate depth, such as, for example, the thickness of the casing or a specified depth for the specific operation. Such depth of cut limits may find application in operations wherein sequentially smaller casing segments are disposed within the same region. Because the depth of cut may be limited, a drilling engineer may elect to cut into a first casing segment (i.e., an inner casing segment) without cutting a second casing segment (i.e., an outer casing segment).

Figure 2A:
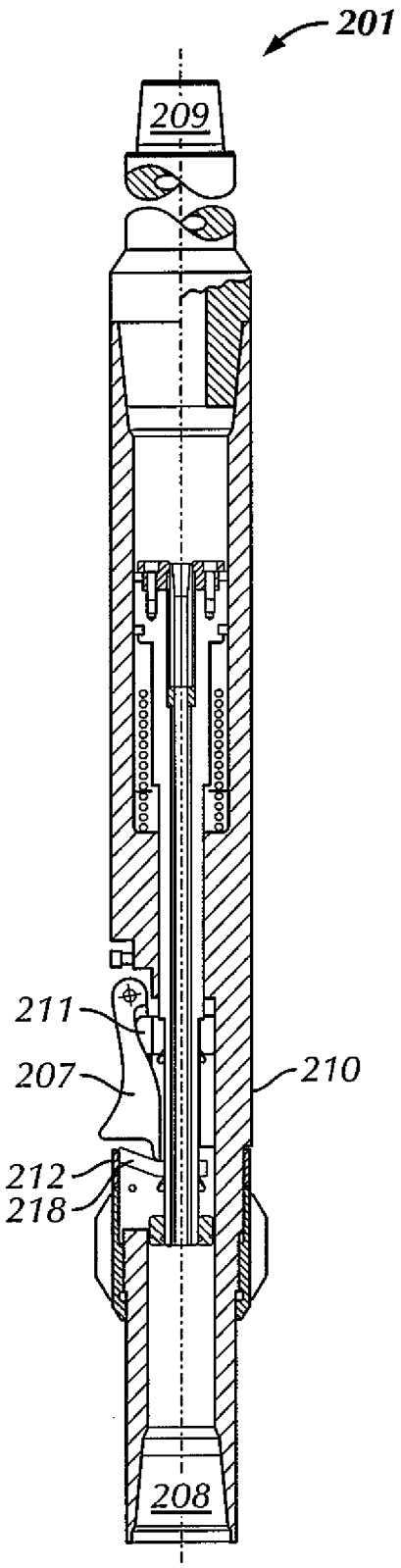
FIGS. 2*a* and 2*b* are schematic views of a cutting device according to embodiments of the present disclosure.
Figure 2B:
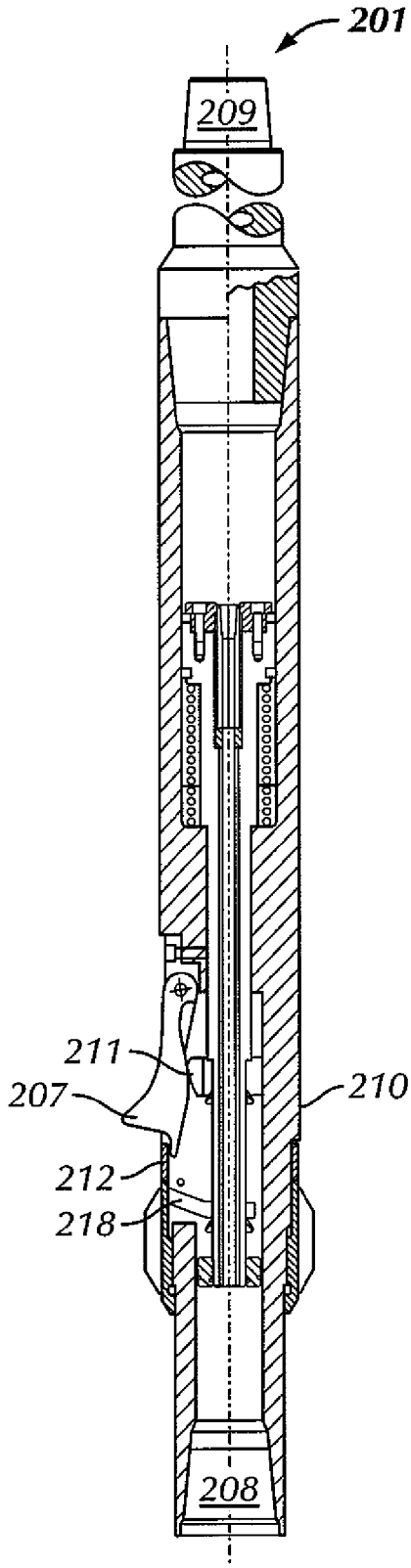

Referring to FIGS. 2A and 2B together, a schematic view of cutting devices according to an embodiment of the present disclosure is shown. In this embodiment, FIG. 2A represents a cutting device 201 in a retracted position (i.e., before actuation), while FIG. 2B represents a cutting device 201 in an extended position, as would occur after actuation and/or during cutting. In this embodiment, cutting device 201 includes a pin 209 disposed on a top portion of the device, and a box 208 disposed on a bottom end of the device. Pin 209 and box 208 allow cutting device 201 to be connected to other components of a drilling tool assembly, such as stabilizers, packoffs, jarring devices, and other components typically used in cutting operations. Those of ordinary skill in the art will appreciate that depending on the tools used in a given operation, cutting device 201 may include pin 209 and box 208 ends in opposite configuration, such that the box 208 is disposed on a top end of cutting device 201, while pin 209 is disposed on a bottom end of cutting device 201.

Cutting device 201 also includes at least one arm 207 disposed partially within a cutting device body 210. In certain embodiments, cutting device 201 includes a plurality of arms 207, and in particular embodiments, three blades 207 oriented around cutting device 201 at approximately 120° may be preferable. Those of ordinary skill in the art will appreciate that the number of arms 207 and the specific orientation of arms 207 around cutting device 201 is not a limitation on the scope of the present disclosure. As such, cutting devices 201 having four, five, six, or more arms 207 may be used. Those of ordinary skill in the art will appreciate that when multiple arms 207 are used, the arms 207 around cutting device 201 should be oriented to balance the arms 207 during cutting. As such, arms 207 disposed at equal orientation with respect to cutting device 201 may benefit the cutting action of cutting device 201, as well as decrease wear to the arms 207 or individual cutters disposed thereon. In certain embodiments, arms 207 may be spring loaded, so as to extend a specified length upon actuation of the cutting device.

In this embodiment, cutting device 201 is hydraulically activated, and the extension of arms 207 from cutting device body 210 may occur according to any known methods in the art. For example, in one embodiment, cutting device 201 may be actuated through a ball drop procedure, wherein a ball with a density equal to the density of the fluid is pumped or dropped through a wellbore tubular. After the ball is seated, such as in a bore of a ball seat body, hydraulic pressure can be applied to operate cutting device 207. In other embodiments, cutting device 201 may be actuated through radio frequency transmission. In such an embodiment, a radio frequency transmitter is pumped through the fluid until it passes by a radio frequency receiver disposed within the drill string and/or device to be activated. The radio frequency receiver then interprets the signal from the radio frequency transmitter, and actuates a component of cutting device 201, such as an arm extender. Examples of radio frequency actuation are known in the art, and may include the methods disclosed in U.S. Pat. Nos. 6,536,524 and 7,063,148 hereby incorporated by reference herein.

In still other embodiments, cutting device 201 may be actuated by varying pressure through nozzles within cutting device body 210. In such embodiments, clutches configured to actuate flow paths within cutting device 201 may be opened or closed by applying a fluid pressure to displace the clutch within the body of the tool. Thus, cutting device 201 may be activated or deactivated by varying a fluid pressure. Other methods of actuating cutting device 201, such as using shear pins and pressure pulses through measurement-while-drilling tools may be used with embodiments of the present disclosure. Accordingly, those of ordinary skill in the art will appreciate that any method of activating downhole components of a drilling tool assembly may be used according to embodiments disclosed herein. Additionally, in certain embodiments, multi-cycle bypass valves may be used to open particular ports of pressurize pistons of different individual cutters and/or spears. For example, in one embodiment, a multi-cycle bypass valve may be used to divert pressure to a particular chamber of a cutting device and/or spearing device to hydraulically actuate the tool for activation. In such an embodiment, chambers of other tools may remain closed, such that only desired tools are activated. By selectively decreasing and increasing the pressure to individual components through signal sent to pressure pulse receivers configured to actuate specific components of the assembly, tools, such as the cutting and spearing devices may be selectively activated and deactivated.

When cutting device 201 reaches a portion of casing to be cut, cutting device 201 may be actuated using one or more of the above-described methods to extend arm 207 from cutting device body 210. In one embodiment, cam 211 is forced in a downward direction within cutting device body 210, such that the movement of cam 211 causes the extension of arm 207 from cutting device body 210. One method of extending arm 207 may include actuating a piston (not shown) within cutting device body 210, such that as the piston moves downwardly, cam 211 moves into contact with arm 207, thereby causing arm 207 to extend into contact with the casing.

In this embodiment, cam 211 is integrally formed to include a locking plate 218 below arm 207. As cam 211 is lowered into position, thereby extending arm 207, locking plate 218 is also lowered within cutting device body 210. When cutting device 201 is in a retracted position (FIG. 2A), locking plate 218 prevents arm 207 from prematurely extending from cutting device body 210. Locking plate 218 may also decrease the tendency of arm 207 to vibrate as cutting device 201 is run into the wellbore. By decreasing vibrations of arm 207, locking plate 218 may prevent arm 207 from becoming loose, which may otherwise result in premature failure of arm 207 during cutting. Locking plate 218, in an alternative embodiment, may be disposed on arm 207 behind cam 211, such that locking place 218 will prevent the premature opening of arm 207 while a piston is in a retracted position. Additionally, disposing locking plate 218 on arm 207 may help retract arm 207 after a cut is made.

Arm 207 of cutting device 201 may also include one or more cutting surfaces (not independently illustrated) to increase the cutting effectiveness and cutting life of cutting device 201. In one embodiment, arm 207 may include one or more knife blades disposed on arm 207. The knife blades and/or cutters may be manufactured from steel, tungsten carbide, or other materials with hardness and impact resistance properties allowing for multiple casing cuts in a single slot recovery operation. To increase the wear resistance of the knife blades and/or cutters, hard facing and/or inserts may be disposed thereon. Those of ordinary skill in the art will appreciate that by increasing the wear resistance of arms 207, knife blades, and cutters, cutting device 201 may be used to make multiple cuts of casing in a single run.

Figure 3A:
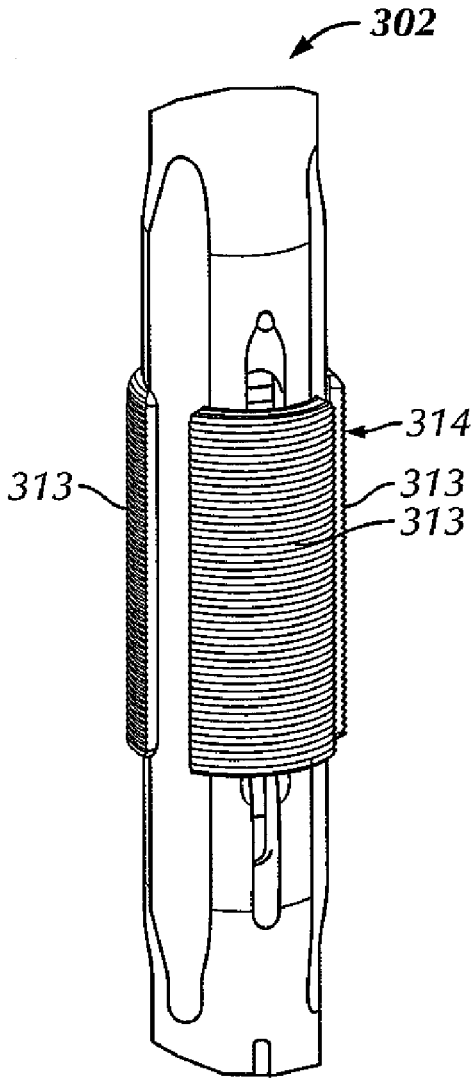
FIGS. 3*a* and 3*b* are schematic views of spearing devices according to embodiments of the present disclosure.
Figure 3B:
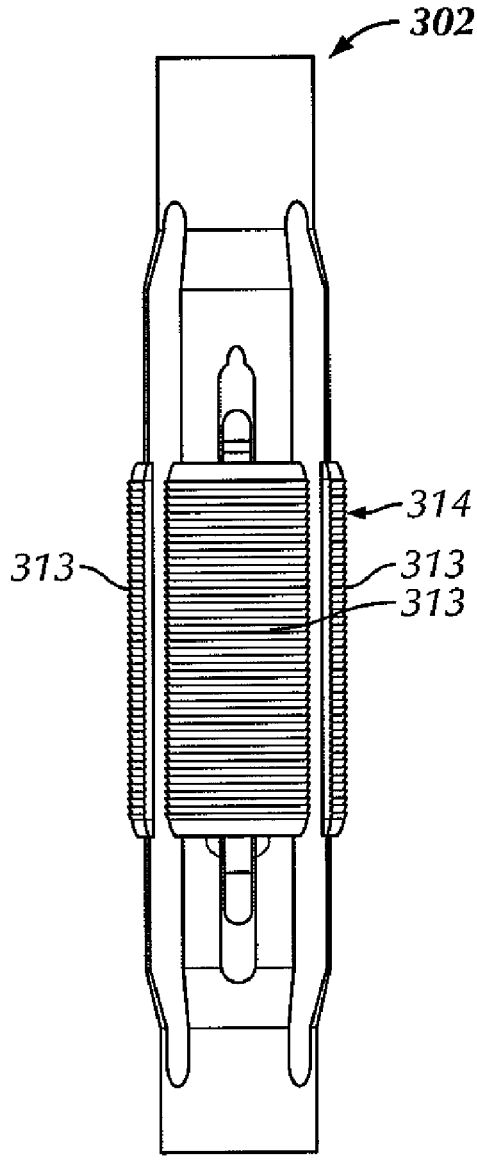

Referring to FIGS. 3A and 3B, schematic views of spearing devices 302 according to embodiments of the present disclosure are shown. Spearing device 302 may include any type of downhole tool capable of internally engaging casing, thereby allowing for removal of the casing from the wellbore. Spearing device 302 includes engagement surface 313 that may be radially extended to contact the casing. Upon contact with the casing, a plurality of teeth 314 grip the casing, so that during removal the casing may be moved upwardly within the wellbore.

In this embodiment, spearing device 302 is hydraulically activated, such that a flow of fluid through the tool causes engagement surface 313 to radially extend into contact with a casing segment. The radial extension of engagement surface 313 may be controlled such that engagement surface 313 extends to a specified outside diameter. As such, the extension of spearing device 302 may be controlled so that casing is not damaged during casing removal operations.

Additionally, in the present embodiment, engagement surface 313 extends in distinct segments around spearing device 302. However, in other embodiments, engagement surface 313 may extend substantially 360° around spearing device 302, while in still other embodiments, engagement surface 313 may constitute a select region of the outer diameter of a portion of spearing device 302. Those of ordinary skill in the art will appreciate that the coverage area of engagements surface 313 is not a limitation on the scope of the present disclosure. However, by increasing the effectiveness of the coverage area, setting the extension to an appropriate outer diameter, and configuring spearing device 302 to withstand multiple jars, the life and effectiveness of spearing device 302 may be increased.

As discussed above with regard to cutting devices, spearing device 302 may also be actuated using any actuation methods known in the art. Exemplary actuation methods include radio frequency, ball drop, pressure point, multiple cycle pressure pulse, and pin based actuation. While the specific type of actuation process is not a limitation on the scope of the present disclosure, by selecting an actuation process that allows for spearing device 302 to extend and retract several times may increase the effectiveness of the casing cutting operation. Additionally, in certain embodiments of the present disclosure, multiple segments of casing may be removed in a single trip. As such, spearing devices capable of removing heavier loads may be preferred, such that a greater number, larger, and/or heavier casing segments may be removed in a single trip.

Figure 4A:
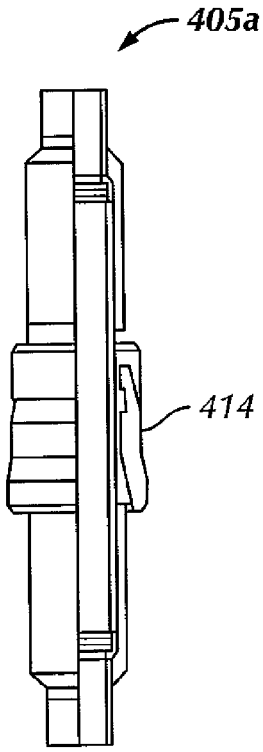
FIGS. 4*a* and 4*b* are schematic views of packers according to embodiments of the present disclosure.
Figure 4B:
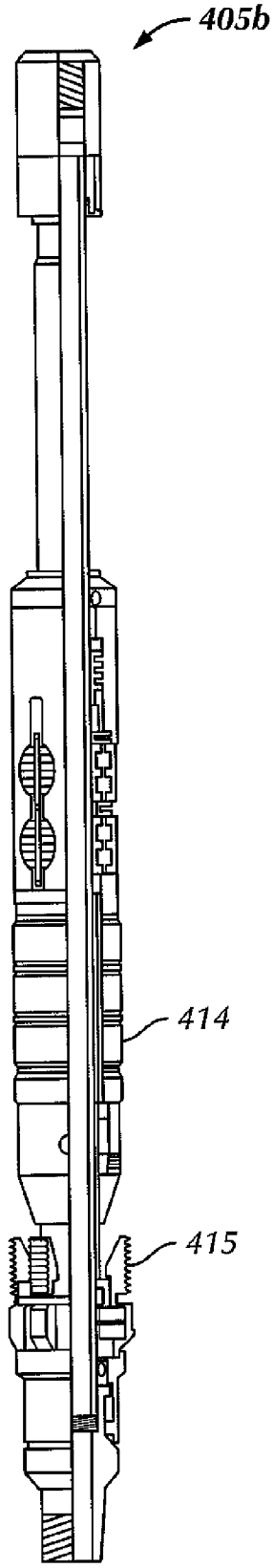

Referring now to FIGS. 4A and 4B, schematic representations of packers 405 according to embodiments of the present disclosure are shown. Packers include devices with a smaller initial outside diameter that expand externally to seal the wellbore, and generally include production and inflatable packers. FIG. 4A illustrates a traditional fixed packer, which is actuated by extending sealing element 414. Upon extension of sealing element 414, the area above packer 405A is sealed off from the area below packer 405A, thereby isolating the two regions of the wellbore. Such a packer may be used in embodiments of the present disclosure to seal off a lower portion of a wellbore during a cutting or pulling operation. In such an embodiment, packer 405A may be disposed on a fishing tool assembly below the cutting devices.

In alternate embodiments, it may be beneficial to seal off a portion of the wellbore during a cutting, spearing or jarring operation, wherein packer 405 is disposed above a cutting device. FIG. 4B illustrates a hydraulically activated packer 405B, that may be set and released multiple times within a single trip of the drill string. In this embodiment, packer 405B includes a plurality of set points 415 that may be radially expanded to contact the inner diameter of casing. After extending set points 415, sealing element 414 may be expanded to seal off the portion of the wellbore below sealing element 414 from the portion above sealing element 414. Additionally, packer 405B may allow for fluid to flow through an inner diameter of packer 405B, such that components of the drilling tool assembly below packer 405B may be controlled. Thus, packer 405B may be disposed on the fishing tool assembly above and/or below cutting devices, and as such, may be used in cutting operations employing a plurality of cutting devices.

In some embodiments, use of a packer 405 may be used to provide hydraulic lift for freeing casing during jarring and/or spearing operations. The hydraulic lift generated by sealing off a lower portion of the wellbore may thereby allow for casing to be freed with less jarring or removed from the wellbore with less surface force. Those of ordinary skill in the art will appreciate that in certain embodiments, packers 405 may not be required for casing cut operations. However, in other embodiments, packers may be used to separate portions of the wellbore while still allowing actuation of other components on the drilling tool assembly, as well increase hydraulic lift.

Figure 5:
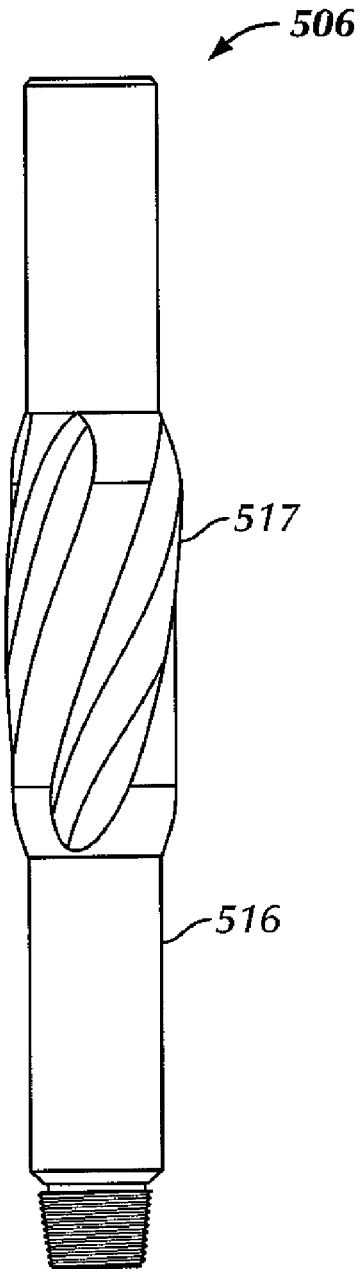
FIG. 5 is a schematic view of a stabilizer according to embodiments of the present disclosure.

Referring to FIG. 5, a stabilizer 506 according to an embodiment of the present disclosure is shown. In this embodiment, one or more stabilizers 506 may be disposed on the drilling tool assembly to reduce vibrations of the drill string during cutting, jarring, and spearing operations, and also to centralize one or more components of the fishing tool assembly. Stabilizer 506 includes an elongate body 516 and a plurality of spiraled ribs 517. The spiraled ribs 517 allow for contact with the internal diameter of the casing to prevent vibrations of the drill string without obstructing fluid flow therethrough. Those of ordinary skill in the art will appreciate that in certain operations, stabilizers may include hardfacing and/or inserts to increase the wear resistance of the tool during use. Additionally, in certain embodiments, the stabilizers may be hydraulically actuated, so as to increase stabilization while the cutting device is cutting casing.

To increase the stability, and thereby decrease vibration of the drill string during operation, the drilling tool assembly may include a plurality of stabilizers disposed along the drill string at specified intervals. To further increase the stability during casing cutting, one or more stabilizers 506 may be disposed above cutting devices. As such, in drilling tool assembly having multiple cutting devices, multiple stabilizers 506 may further reduce vibrations of the drill string. For example, in one embodiment having 3 cutting devices, three stabilizers 506 may be disposed along the drill string, each stabilizer being placed above a respective cutting device. Those of ordinary skill in the art will appreciate that the location of stabilizers 506 relative to the cutting devices may vary according to the requirements (e.g., the vibrational tendencies) of the drilling tool assembly.

In still other embodiments of the present disclosure jarring devices may be disposed on the fishing tool assembly. Jarring devices allow for a driller to deliver a controllable up, down, or up and down impact force to another component of the drill string. Those of ordinary skill in the art will appreciate that both mechanical and hydraulic jars may be used according to embodiments of the present disclosure. For example, in one embodiment, to generate the impact force, a spearing device is engaged with cut casing. As the drill string is moved in an upward axial direction, the drill string is stretched, thereby storing kinetic energy. During the stretching, an upper portion of the jarring device is allowed to move axially with respect to a lower portion. When the jarring device reaches a firing point, the upper portion of the jarring device is allowed to move axially relative to the lower potion, thereby striking a shoulder portion of the lower portion, and imparting an impact load thereto. The impact load then transmits the force of the contact to lower components of the drilling tool assembly. Because the spearing device is holding a cut casing segment, the impact force may thereby free the cut casing segment from the remainder of the casing. Those of ordinary skill in the art will appreciate that in certain embodiments, multiple jarring actions may be performed to free cut casing if a first jar does not release the casing segment.

In certain embodiments, to further increase the amount of force generated by the jarring device, a jar accelerator may be disposed proximate the jarring device. An accelerator allows for kinetic energy to be stored within the accelerator, thereby replacing the requirements of pipe stretch required by traditional jarring devices. In a jar accelerator, fluid compression within the tool compensates for limited pipe stretch, providing the stored energy, and allowing for increased impact force with limited pipe stretch. Those of ordinary skill in the art will appreciate that by increasing the force generated by the jarring device through the use of a jar accelerator, more force may be used to free the cut casing segment. Additionally, in embodiments having multiple cutting devices located both above and below the jarring device, the up and down impact force may allow for casing segments to be speared and freed with a single jarring motion. By decreasing the number of jars required to free the casing, the integrity of other components may be maintained, thereby prolonging the life of the drilling tool assembly.

During slot recovery operations, varied configurations of bottom hole assemblies using the above-described components may be used. Referring back to FIG. 1, the operation of drilling tool assembly 100 during slot recovery operations will be described in detail. Initially, drilling tool assembly 100 is disposed in a wellbore, wherein drilling tool assembly 100 includes at least a cutting device 101, a spearing device 102, and a jarring device 104. As described above, drilling tool assembly 100 may also include various other components, such as stabilizers 106, packers 105, and/or jarring accelerators 103.

In one embodiment, drilling tool assembly 100 is disposed in a wellbore, and lowered to a portion of the wellbore where a casing cut is desirable. When drilling tool assembly 100 reaches the preferred casing section, cutting device 101 is activated by, for example, radio frequency transmission, ball drop actuation, pressure actuation, pressure pulse from the surface to the tool, such as through measurement while drilling tools, or any other actuation method known to those of ordinary skill in the art. Activation of cutting device 101 allows for a first casing segment to be cut. After the first casing segment is cut, cutting device 101 is deactivated, and spearing device 102 is activated. Spearing device 102 is engaged with the cut casing segment, and jarring device 104 is activated, so as to free the first casing segment. Because spearing device 102 is engaged with the first casing segment, drilling tool assembly 101 may be pulled up, and the casing segment removed from the wellbore.

In other embodiments, after the first casing segment is cut and spearing device 102 is engaged with the cut casing segment, cutting device 101 may be re-activated, and a second casing cut may be made. In certain embodiments, two casing cuts may be required, such that upon jarring the casing segment, the casing segment is freed. To increase the precision of the casing cuts, stabilizers 106 may be disposed on drilling tool assembly 100 to centralize cutting device 101 within the wellbore. By centralizing cutting device 101, the individual cutters of cutting device 101 may be controlled, such that a preferred depth of cut may be maintained. Additionally, centralizing cutting device 101 may decrease the wear on the individual cutters, thereby increasing the life of cutting device 101.

Figure 6:
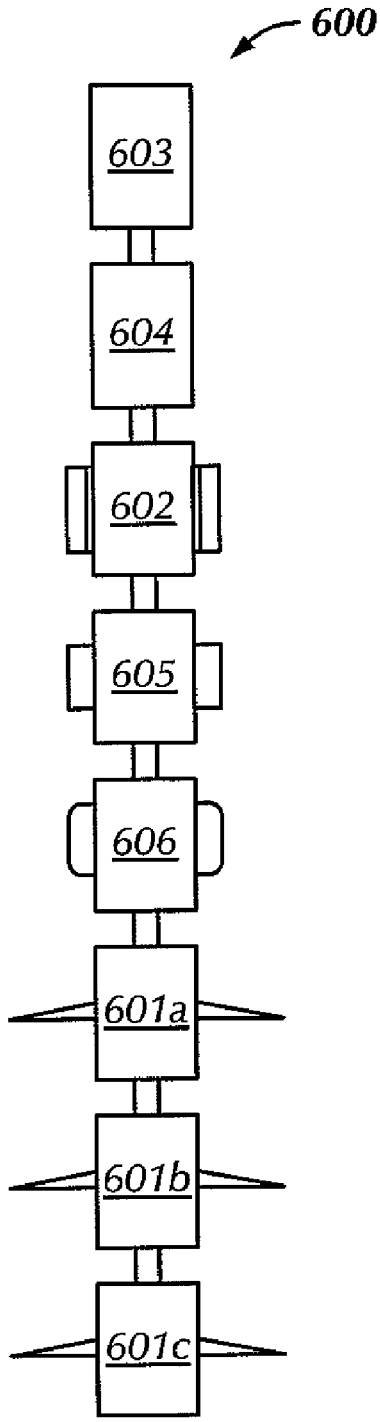
FIG. 6 is a schematic representation of a drilling tool assembly according to embodiments of the present disclosure.

Referring to FIG. 6, a drilling tool assembly 600 according to an alternate embodiment of the present disclosure is shown. In this embodiment, drilling tool assembly includes multiple cutting devices 601*a*, 601*b*, 601*c*, a spearing device 602, and a jarring device 604. As described with respect to FIG. 1, fishing tool assembly 600 may also include additional components, such as jarring accelerators 603, packers 605, and/or stabilizers 606.

In this embodiment, fishing tool assembly 600 may be disposed in a wellbore and activated similar to the activation of drilling tool assembly 100 of FIG. 1. However, in this embodiment, after a first casing segment is cut, and cutting device 601*a* is deactivated, fishing tool assembly 600 may either be raised or lowered into the wellbore to a different depth, and additional cuts may be made. For example, in one embodiment, cutting device 601*a* may be activated and deactivated so as to make three cuts. After three cuts, the cutters of cutting device 601*a* may be worn such that additional cuts can not be made. However, rather than remove fishing tool assembly 600 from the wellbore so that the cutters and/or cutting device 601*a* may be replaced, cutting device 601*a* may be deactivated, and cutting device 601*b* may be activated, such that additional cuts may be made. Those of ordinary skill in the art will appreciate that the process of deactivating one of cutting devices 601*a*, 601*b*, or 601*c* and activating a different cutting device 601*a*, 601*b*, or 601*c* may occur in any order. For example, in certain embodiments, the lowest cutting device 601*c* may be activated first, while in other embodiments, cutting device 601*a* or 601*b* may be activated first. The order of activation of cutting devices 601*a*, 601*b*, and 601*c* will depend on the requirements of the casing cutting operation, as well as the depth of the casing segments within the wellbore.

Multiple cutting devices 601 may allow for multiple casing cuts to be made in a single trip of the drill string. Typically, cutters of cutting devices 601 will wear down after two to three cuts. As such, the drill string would have to be tripped after two to three cuts. However, drilling tool assembly 600 may be capable of making multiple cuts, such as twelve or more cuts, thereby decreasing the number of trips of the drill string required to cut and remove casing segments from the wellbore. In other embodiments, multiple cutting devices 601 may serve as redundant cutting devices, such that if one of the cutting devices 601 loses functionality or if the cutters of a first cutting device wear down prematurely, a second cutting device may be used. Those of ordinary skill in the art will appreciate that depending on the requirements of the casing cutting operation, the number of cutting devices 601 may vary. As such, bottom hole assemblies having one, two, three, four, or more cutting devices are within the scope of the present disclosure.

Figure 7:
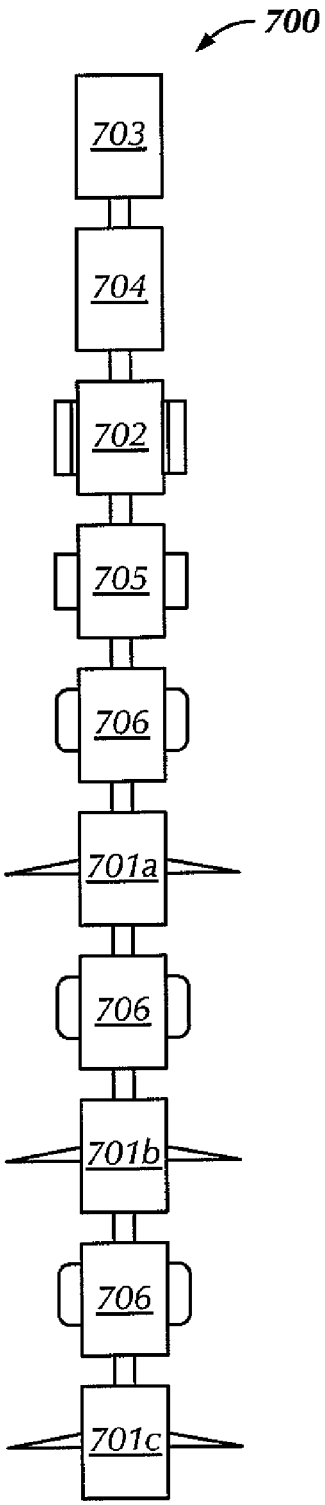
FIG. 7 is a schematic representation of a drilling tool assembly according to embodiments of the present disclosure.

Referring to FIG. 7, a drilling tool assembly 700 according to one embodiment of the present disclosure is shown. In this embodiment, drilling tool assembly 700 includes multiple cutting devices 701*a*, 701*b*, and 701*c*, a spearing device 702, and a jarring device 704. Drilling tool assembly 700 also includes various optional components, such as a jarring accelerator 703, packers 705, and a plurality of stabilizers 706.

In this embodiment, the configuration of stabilizers 706 may allow for near cutting device centralization during activating of any of cutting devices 701*a*, 701*b*, and/or 701*c*. As illustrated, stabilizers 706 are located at least above each of cutting devices 701. As such, as cutting devices 701 are activated, the drill string may be centralized in a location close to cutting device 701. By increasing stabilization and thus centralization of the drill string close to the individual cutting devices, the precision of cuts made by each cutting device 701 may be increased. Those of ordinary skill in the art will appreciate that the spacing of the individual stabilizers 706 will vary based on the type of casing being cut and the parameters of the drilling tool assembly 700. However, by decreasing the space between cuttings devices 701 and stabilizers 706, the centralization of the individual cutting devices 701 may be increased. Additionally, in certain embodiments, it may be beneficial to have stabilizers 706 disposed along the drill string both above and below cutting devices 701.

Figure 8:
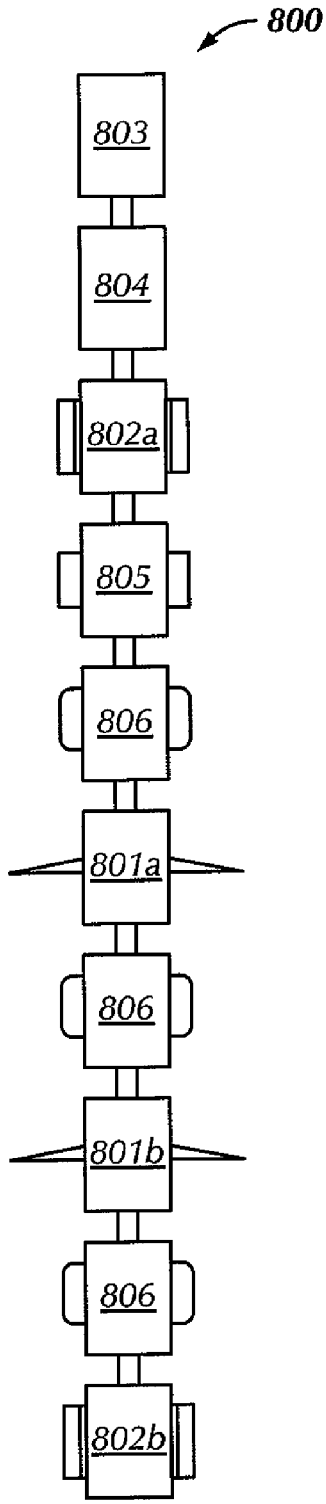
FIG. 8 is a schematic representation of a drilling tool assembly according to embodiments of the present disclosure.

Referring to FIG. 8, a drilling tool assembly 800 according to one embodiment of the present disclosure is shown. In this embodiment, drilling tool assembly 800 includes multiple cutting devices 801*a* and 801*b*, multiple spearing devices 802*a* and 802*b*, and a jarring device 804. Drilling tool assembly 800 also includes various optional components, such as a jarring accelerator 803, packers 805, and a plurality of stabilizers 806.

Drilling tool assembly 800 includes multiple spearing devices 802*a* and 802*b*, thereby increasing the number of cut casing segments that may be removed from the wellbore in a single trip. Drilling tool assembly 800 may thus be used in a cutting operation wherein cutting device 801*a* is activated, and a first casing segment is cut. Spearing device 802*a* may then be activated, thereby engaging spearing device 802*a* with the first casing segment, and jarring device 804 may be activated to free the cut casing segment from the wellbore. Subsequently, second cutting device 801*b* may be activated, and a second casing segment may be cut. Spearing device 802*b* may then be activated, so as to engage the cut casing segment. Jarring device 803 may then be reactivated, and the second casing segment may be freed from the wellbore. The above described method of cutting, spearing, and jarring may be repeated as many times as the cutters on individual cutting devices 801 allow. As such, multiple casing segments may be cut, speared, and removed from the wellbore in a single trip.

Those of ordinary skill in the art will appreciate that the order of operation of the individual components may be varied, without departing from the scope of the present disclosure. For example, in one embodiment, cutting device 801*a* may be activated, and a first casing cut made. Cutting device 801*a* may then be deactived, and the drill string lowered axially within the wellbore. Cutting device 801*a* may then be reactivated, and a second casing cut may be made. This process of making multiple casing cuts may be repeated for the life of the cutters on cutting device 801*a*. After the desired number of casing cuts are made, spearing device 802*a* may engage one or more of the cut casing segments, and jarring device 804 may be activated to help free the casing cuts.

In other embodiments, after the plurality of casing cuts by cutting device 801*a* have been made, cutting device 801*b* may be activated, and a plurality of additional casing cuts may be made. Similar to the function of cutting device 801*a*, cutting device 801*b* may be activated and deactivated until the desired number of casing cuts have been made. After all of the casing cuts have been made by both cutting devices 801*a* and 801*b*, one or more of spearing devices 802*a* and 802*b* may be activated to engage the cut casing segments. In one embodiment, both spearing devices 802*a* and 802*b* may be activated, while in other embodiments only one of spearing devices 802*a* or 802*b* may be required to allow for the removal of the cut casing segments from the wellbore. Those of ordinary skill in the art will appreciate that it may only be necessary to engage the lowest axial spearing device, in this embodiment 802*b*, when removing the casing segments. Because the higher axial casing segments will be pulled up to the surface of the wellbore as the lowest axial casing segment is pulled upwardly, only one spearing device 802*b* may be required to remove multiple casing segments. However, in certain embodiments, it may be beneficial to engage multiple spearing devices 802 with the cut casing segments so as to increase the contact area between the spearing device 802 and the casing being removed. By increasing the surface area of the contact between the spearing device 802 and the casing, more casing may be removed from the wellbore in a single trip.

Any of the above described embodiments may allow for multiple casing segments to be removed from a wellbore in a single trip. The order of operation of specific embodiments of the present disclosure may vary according to the requirements of the cutting operation. For example, in certain embodiments, multiple casing cuts may be made, followed by a single spearing and jarring. In other embodiments, multiple casing cuts may be followed by multiple spearing and jarring. Accordingly, all of the casing cuts may be made initially, followed by spearing the lowest axial cut casing segment, jarring one or more of the segments, and then removing the freed casing segments from the wellbore. Those of ordinary skill in the art will appreciate that each cut casing segment may be jarred loose separately. In other embodiments, it may be beneficial to cut a desired number of casing segments, spear the segments, and then cut additional segments. In such an embodiment, multiple spearing devices may facilitate the cutting and removing of the cut casing segments from the wellbore.

Advantageously, embodiments of the present disclosure may allow for casing segments to be cut, speared, and removed from a wellbore in a single trip of the drill string. By providing multiple cutting devices that may be sequentially activated by the use of, for example, radio frequency transmission, sequentially sized ball drop actuation, pressure pulse actuation, and/or pressure thresholds, a plurality of casing segments may be cut, speared, and removed from the wellbore. By removing multiple casing segments in a single trip, valuable time may be saved in slot recovery operations. Additionally, by decreasing the number of trips of the drill string to cut and recover casing segments, the cost of a slot recovery operation may be decreased.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method of removing casing from a wellbore, the method comprising:

disposing a drilling tool assembly in a wellbore, the drilling tool assembly comprising a cuffing device, a spearing device, and a jarring device;

activating the cutting device;

cutting a first casing segment;

deactivating the cutting device and activating the spearing device;

engaging the spearing device with the first casing segment;

activating a second cutting device;

cutting a second casing segment;

activating the jarring device to free the first casing segment; and removing the second casing segment with the first casing segment from the wellbore in a single trip.

2. The method of claim 1, further comprising:

activating a stabilizer in the wellbore to centralize the cutting device in the casing.

3. The method of claim 1, wherein at least one of the activating and deactivating comprises:

transmitting a radio frequency signal.

4. The method of claim 1, wherein at least one of the activating and deactivating comprises ball-operated actuation.

5. The method of claim 4, wherein the ball-operated actuation comprises sequentially sized balls.

6. The method of claim 1, wherein at least one of the activating and deactivating comprises locking pin actuation.

7. The method of claim 1, wherein at least one of the activating and deactivating comprises pressure threshold actuation.

8. The method of claim 1, wherein at least one of the activating and deactivating comprises pressure pulse actuation.

9. The method of claim 1, wherein the spearing device comprises a grapple.

10. The method of claim 1, further comprising:

cutting a second casing segment with the first cutting device; and removing the first and second casing segments from the wellbore in a single trip.

11. The method of claim 1, further comprising:

activating a second spearing device; and engaging the second spearing device with the casing.

12. A downhole tool for cutting and removing casing from a wellbore, the tool comprising:

a first retractable cutting device disposed on a drill string and configured to make a first casing cut;

a second retractable cutting device disposed above the first retractable cutting device and configured to make a second casing cut;

a spearing device disposed on the drill string and configured to engage the casing wherein casing cut by the first retractable cutting device and casing cut by the second retractable cutting device are configured to be removed from the wellbore by the spearing device in a single trip; and a jarring device disposed on the drill string.

13. The downhole tool of claim 12, further comprising:

a second spearing device disposed on the drill string.

14. The downhole tool of claim 12, wherein at least one of the first and second retractable cutting assemblies comprises a piston configured to extend a cutter into engagement with casing.

15. The downhole tool of claim 14, wherein at least one of the first and second retractable cutting assemblies comprises a catch configured to lock the piston into place.

16. The downhole tool of claim 12, further comprising:

a pressure pulse receiver configured to actuate one of the first and second retractable cutting assemblies.

17. The downhole tool of claim 12, further comprising:

a radio frequency receiver configured to actuate at least one of the first and second retractable cutting assemblies, the spearing device, and the jarring device.

18. The downhole tool of claim 12, further comprising:

a stabilizer disposed on the downhole tool and configured to centralize at least one of the first and second retractable cutting assemblies within the casing.

19. The downhole tool of claim 12, further comprising:

a packer disposed on the drill string above the first retractable cutting assembly.

20. The downhole tool of claim 12, wherein the spearing device is configured to engage the casing and allow the casing cut by the first and second retractable cutting assemblies to be removed from the wellbore in a single trip.

* * * * *